US005217737A

United States Patent [19]

Gygax et al.

[11] Patent Number: 5,217,737

[45] Date of Patent: Jun. 8, 1993

[54] PLASTIC CONTAINERS CAPABLE OF SURVIVING STERILIZATION

[75] Inventors: Ralph A. Gygax, Westerville; Joseph M. Lippian, Worthington; Thomas D. Loughrin; William T. Malone, both of Columbus; Thomas W. Osip; Paul A. Pezzoli, both of Worthington, all of Ohio

[73] Assignee: Abbott Laboratories, Abbott Park, Ill.

[21] Appl. No.: 702,558

[22] Filed: May 20, 1991

[51] Int. Cl.[5] ..... B65D 23/00; B65D 1/02; B65D 1/09; B65D 1/14

[52] U.S. Cl. ..... 426/111; 215/1 C; 220/609; 426/106; 426/113; 426/127; 426/131; 426/407

[58] Field of Search ..... 426/111, 113, 131, 106, 426/127, 407, 399, 401; 220/609, 608; 215/1 C

[56] References Cited

U.S. PATENT DOCUMENTS

| | | | |
|---|---|---|---|
| 2,982,440 | 5/1961 | Harrison | 426/111 |
| 3,400,853 | 9/1968 | Jacobsen | 426/111 |
| 3,409,167 | 11/1968 | Blanchard et al. | 220/609 |
| 3,690,507 | 9/1972 | Gallus et al. | 220/608 |
| 3,693,828 | 9/1972 | Kneusel et al. | 220/608 |
| 3,701,455 | 10/1972 | Warnecke | 220/608 |
| 3,905,507 | 9/1975 | Lyu | 220/608 |
| 3,942,673 | 3/1976 | Lyu et al. | 220/608 |
| 4,120,419 | 10/1978 | Saunders | 220/609 |
| 4,125,632 | 11/1978 | Vosti et al. | 426/111 |
| 4,147,271 | 4/1979 | Tamaguchi | 220/609 |
| 4,151,927 | 5/1979 | Cvacho et al. | 220/609 |
| 4,177,746 | 12/1979 | Lee et al. | 220/609 |
| 4,222,494 | 9/1980 | Lee et al. | 220/608 |
| 4,255,457 | 3/1981 | Collias | 426/131 |
| 4,276,987 | 7/1981 | Michel | 215/1 C |
| 4,381,061 | 4/1983 | Cerny | 426/111 |
| 4,412,627 | 11/1983 | Houghton et al. | 220/609 |
| 4,431,112 | 2/1984 | Yamaguchi | 220/609 |
| 4,542,029 | 9/1985 | Caner et al. | 426/131 |
| 4,735,339 | 4/1988 | Benge et al. | 426/107 |
| 4,875,597 | 10/1989 | Saunders | 426/131 |
| 4,880,129 | 11/1989 | McHenry et al. | 426/111 |
| 4,993,567 | 2/1991 | Eberle | 215/1 C |
| 5,005,716 | 4/1991 | Eberle | 215/1 C |

OTHER PUBLICATIONS

Sales Brochure from *Ross Laboratories*, 1987, showing bottle to *Pedialyte* ®.

*Primary Examiner*—Steven Weinstein

*Attorney, Agent, or Firm*—Lonnie R. Drayer; Donald O. Nickey

[57] ABSTRACT

Retortable high panel strength plastic containers have a recessed circular center portion in the bottom wall of the container which facilitates the volumetric changes in the container during a sterilization process. Examples of containers having this feature are disclosed as well as the cross-sectional profile of the recessed circular center portions of the bottom walls of the containers.

20 Claims, 7 Drawing Sheets

PLASTIC CONTAINERS CAPABLE OF SURVIVING STERILIZATION

TECHNICAL FIELD

The present invention relates generally to plastic containers, and more particularly to retortable plastic containers having a high panel strength and a bottom configuration which reduces problems heretofore associated with the sterilization of plastic containers containing liquids.

BACKGROUND OF THE INVENTION

Many products which require sterilization, such as nutritionals and pharmaceuticals, have traditionally been packaged in glass containers. The technology associated with the sterilization of glass containers is very well developed. Glass bottles are most frequently sterilized under conditions in which there is a net vacuum inside the container so as not to subject the glass to tension during sterilization.

However, consumers have increasingly indicated a preference for plastic containers, due to factors such as lower cost, lower potential for container breakage with dangerous sharp debris, lower weight, and ecological concerns. In some instances a very hot liquid is placed into a plastic container during a "hot filling" operation and the plastic container is not subjected to retort conditions. However; for some products the plastic containers are filled with a relatively cool liquid and then subjected to retort conditions to sterilize the contents. The sterilization of plastic containers has required careful control of sterilizer pressure in order to minimize excessive container deformation and the resulting catastrophic failure of such containers. In addition, the rate of change of sterilizer temperature has tended to be constrained by the need to minimize container-to-container temperature variations and thus the simultaneous need for different pressures for different containers within the sterilizer. Also, the maximum allowable container temperature has been limited due to a tendency of the plastic containers to become weaker at higher temperatures and a need for excessive pressures to prevent container deformation.

Typically, when containers are filled steam is injected into the container just prior to the container being sealed. During sterilization, problems can arise with the deformation of a sealed container due in part to the inter-relatedness of product volume, headspace gas volume, and container volume. In a container packed without the use of a vacuum, the volume of product and the volume of the headspace gas equal the volume of the container. In a container packed under a vacuum, the volume of product plus the volume of the headspace gas is less than the volume of the sealed container and the total fill equals the headspace volume plus the product volume.

The sterilization of plastic containers presents the possibility of encountering a problem herein referred to as catastrophic failure. Containers which experience catastrophic failure exhibit post-sterilization shapes which do not approximate the containers' pre-sterilization shape. If a failure occurs in the bottom of a container due to inadequate sterilizer pressure, the failure is called a buckled bottom or end. If a failure occurs in a sidewall of a container due to either inadequate or excessive sterilizer pressure, the failure is called a panel failure. Closure failure and failure of other container features are also common.

One proposed solution to the long felt need for a retortable plastic container is disclosed in U.S. Pat. No. 4,125,632. This patent proffers as the solution to the problem of catastrophic failure the presence of localized thin spots in the bottom wall of a container to facilitate expansion and contraction of the container's bottom during sterilization. This patent discloses that it is critical that the thickness of the sidewall must be thicker than the thickness of the base. Unfortunately, due to the criticality of the varying wall thickness the plastic container disclosed in U.S. Pat. No. 4,125,632 the can taught therein can only be made using certain manufacturing methods. For example, the container disclosed in the patent can not be made by extrusion blow molding.

Commonly owned U.S. patent application Ser. No. 07/638,281 filed on Jan. 4, 1991, now abandoned, discloses a retortable plastic container having a low panel strength and a bottom profile described by a particular equation. If a designer or engineer should choose to provide a container with features that result in a high panel strength such as using stronger plastics, using thick sidewalls or employing strengthening features such as ribs, catastrophic failures may still be frequently experienced. The teachings of this copending patent application still leave unsolved the problem of catastrophic failure during sterilization of a plastic container having a high panel strength.

As used herein and in the claims "panelling" is understood to mean a localized deformation in the sidewall of a container. As used herein and in the claims "panel strength" is understood to mean the net external pressure (difference between external and internal pressure) at which the sidewall of an empty sealed container buckles at a temperature of 70° F. As used herein and in the claims a "high panel strength" is understood to mean a panel strength of greater than 2.54 p.s.i.

A critical performance requirement in retortable plastic containers with high panel strength is the capability of a container to deform in such a manner as to increase the volume of the container with increasing temperature and internal pressure, and decrease the volume of the container with decreasing temperature and internal pressure without experiencing a catastrophic failure. One benefit of a container possessing this capability is that with an increasing range of allowable container volumes during sterilization the variation of the internal pressure in a container experienced during a given sterilization process is reduced. However, this capability also minimizes both the magnitude and range of internal pressures in containers during sterilization. These two effects in synergistic combination reduce the possibility that either inadequate or excessive sterilizer pressure will cause a container to sustain a catastrophic container failure. Another benefit is that this capability also provides markedly larger allowable ranges of operating parameters which are ancillary to the sterilization process such as product fill, headspace gas volume, sterilizer pressure, product temperature, etc.

Containers which have the capability to expand a significant amount during sterilization and return substantially to their pre-sterilization shape without experiencing a catastrophic failure are easier to sterilize because such containers can survive diverse temperature-pressure conditions, thus allowing the use of rapid heating and cooling batch and continuous sterilizers, dependent on container fill conditions. Preferably a container must be able to deform to provide a container volume increase of as much 6%, corresponding to the thermal expansion of the liquid packaged in the container, dependent on headspace gas volume, and preferably in excess of 10% without experiencing catastrophic failure of the container. This capability is especially advantageous when sterilizing heat sensitive nutritional and pharmaceutical products in which minimizing the thermal degradation of either product nutrition or medical potency is essential. Another coincident benefit is significantly reduced manufacturing costs due to higher sterilizer productivity. In a high panel strength container the majority of the expansion needs to occur in the bottom wall of the container, and a container in accordance with the invention disclosed herein has a recessed circular center portion which allows the required volume changes without panelling of the container.

It is apparent that a need exists for improved high panel strength plastic containers capable of surviving retort in high-speed sterilization equipment.

BRIEF DESCRIPTION OF THE DRAWINGS

The following detailed description of the invention may be better understood by referring to the annexed drawings wherein.

DETAILED DESCRIPTION OF THE INVENTION

Figure 1:
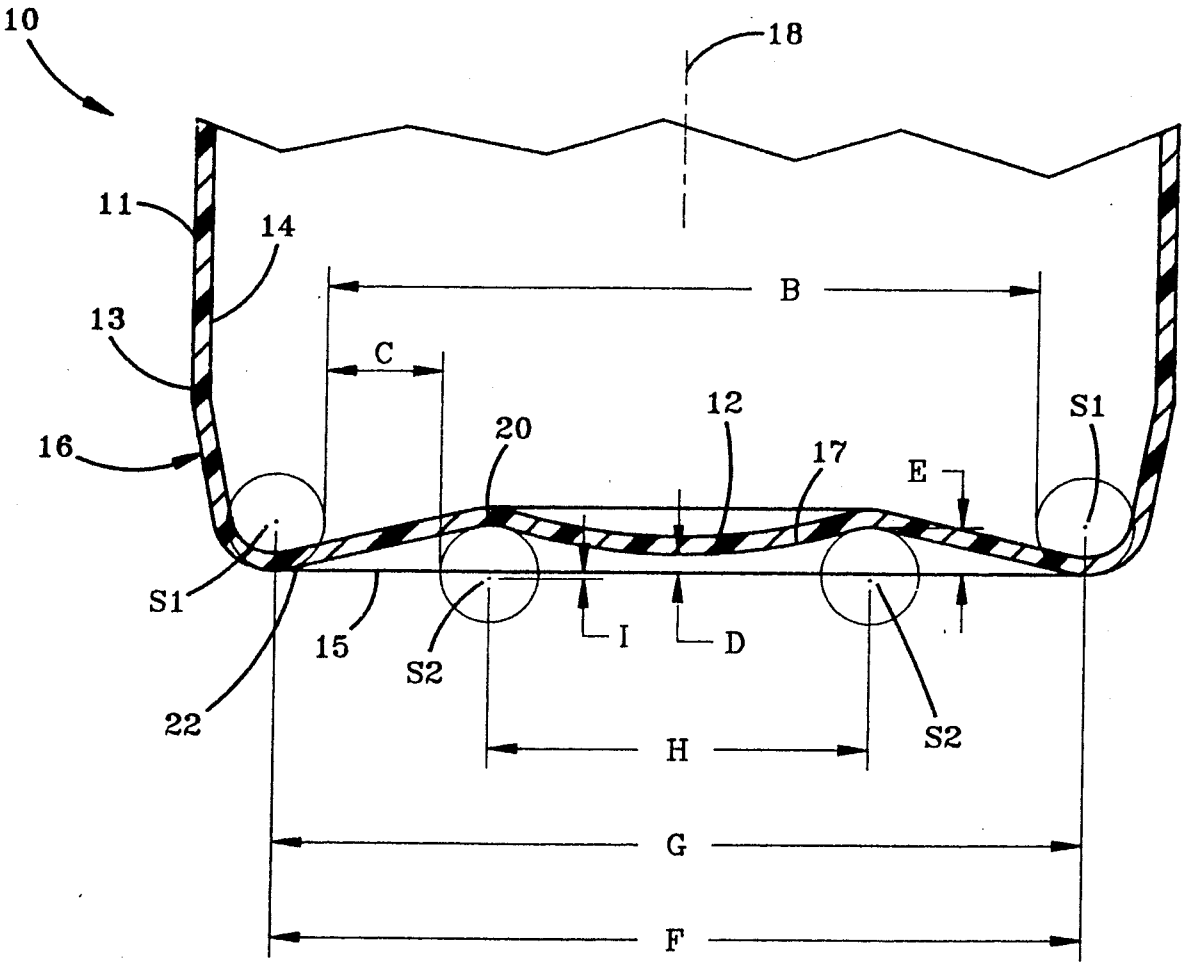
FIGS. 1–7 are fragmentary cross-sectional views taken in a vertical plane showing the base portions of plastic containers according to the invention taken in a vertical plane.
Figure 2:
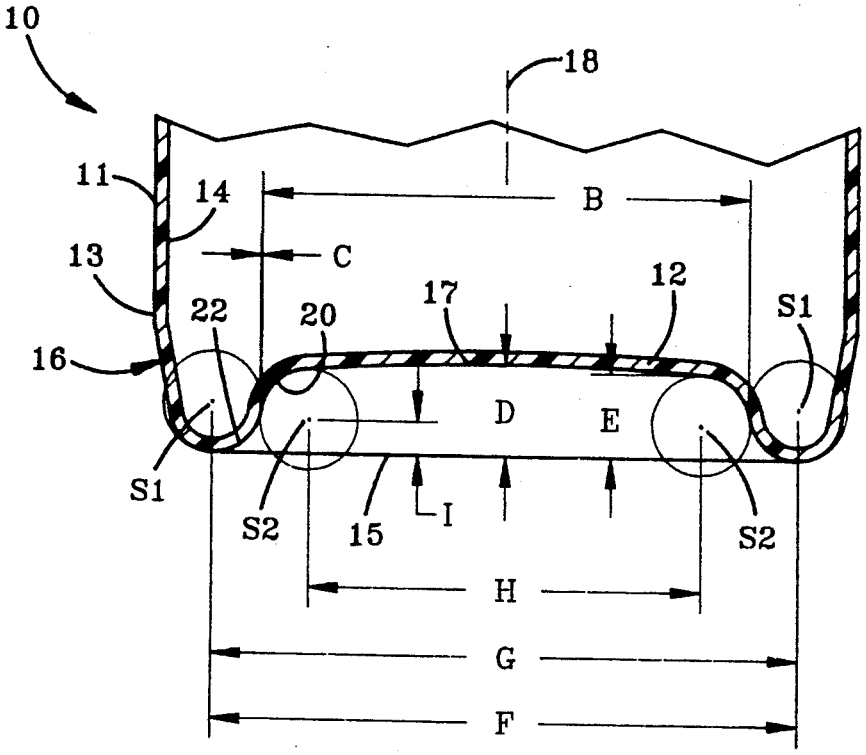
Figure 3:
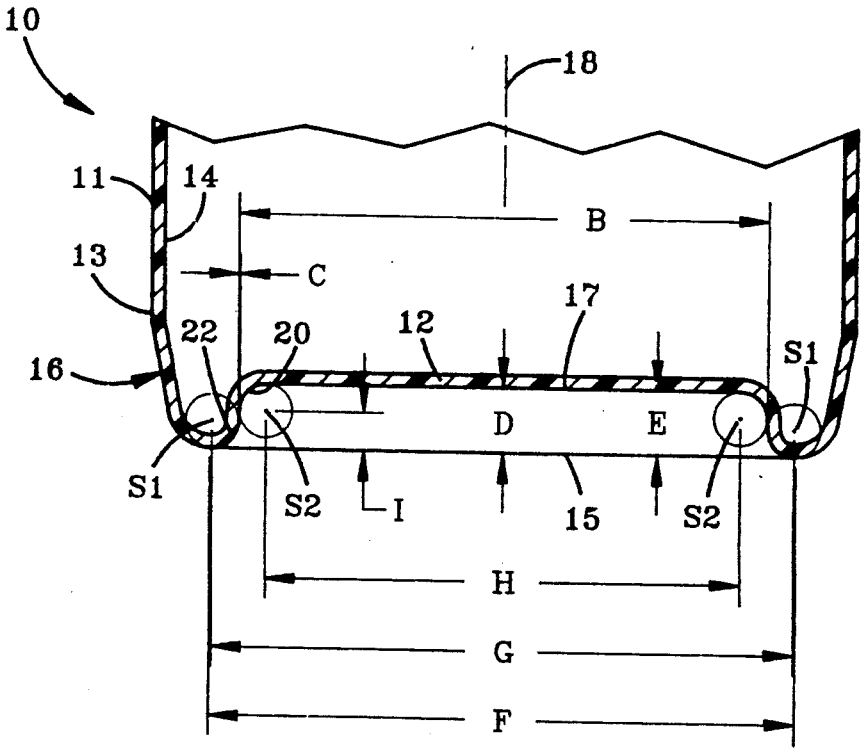
Figure 4:
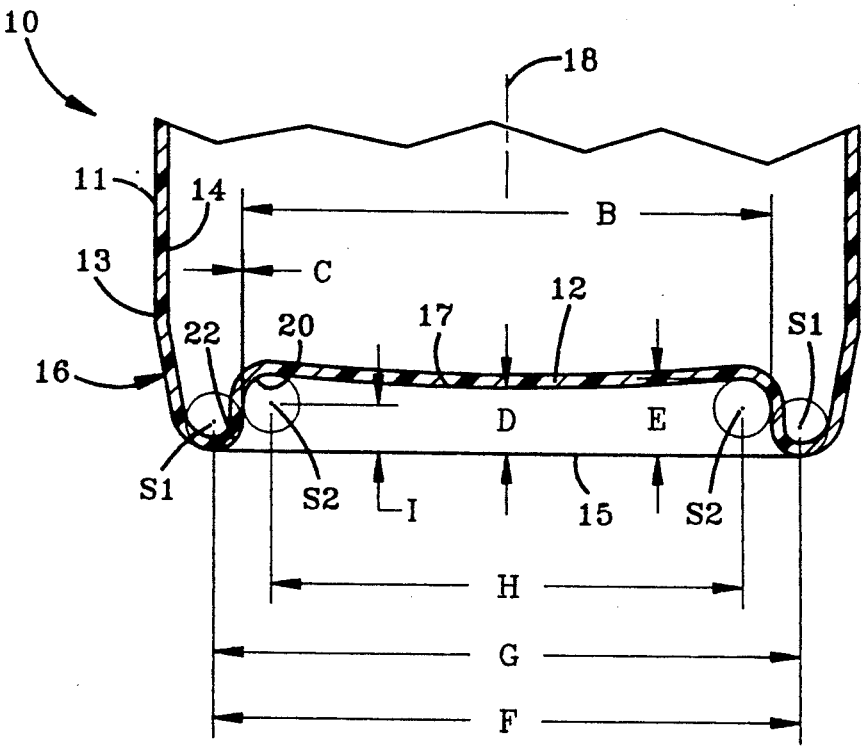

An example of a base portion of a retortable high panel strength plastic container 10 according to the invention is shown in FIG. 1, which is a fragmentary cross-sectional view taken in a vertical plane which contains the longitudinal axis 18 of the container.

As used herein and in the claims "container" is understood to mean a container by itself without a closure.

As used herein and in the claims "panelling" is understood to mean a localized deformation in the sidewall of a container. As used herein and in the claims "panel strength" is understood to mean the net external pressure (difference between external and internal pressure) at which the sidewall of an empty sealed container buckles at a temperature of 70° F. As used herein and in the claims "high panel strength" is understood to mean a panel strength of greater than 2.54 p.s.i.

As used herein and in the claims "plastic" is understood to have the meaning stated in ASTM D883-5T, to wit: a material that contains as an essential ingredient an organic substance of large molecular weight, is solid in its finished state, and, at some stage in its manufacture, or in its processing into finished articles can be shaped by flow.

As used herein and in the claims terms such as "upper", "lower", "top", "bottom" and other words describing relative vertical locations are understood to refer to a container that is sitting on a flat and level surface such that the longitudinal axis 18 of the container is oriented perpendicular to the flat surface.

As used herein and in the claims "vertical" is understood to mean a direction which is both parallel to the longitudinal axis of a container and perpendicular to a flat and level surface upon which the container is resting, and "horizontal" is understood to mean a direction which is both perpendicular to the longitudinal axis of a container and parallel to a flat and level surface upon which a container is resting.

As used herein and in the claims "radial" and "radially" are understood to means directions which are perpendicular to the longitudinal axis of the container, with "radially inward or inwardly" being a direction going towards the longitudinal axis and "radially outward or outwardly" being a direction going away from the longitudinal axis.

The base portion of the container 10 includes a sidewall 11 and a bottom wall 12 which are formed as a single piece. The container has an exterior surface 13 and an interior surface 14. At the lowermost portion of the exterior surface of the bottom wall of the container is a resting surface 15, at a heel portion 16 of the base portion of the container 10, which extends circumferentially about a recessed circular center portion 17 of the bottom of the container which has as its center the longitudinal axis 18 of the container. Associated with the curvature of the exterior surface 13 of the bottom of the container at both an inside corner 22 which connects the resting surface with the recessed center portion and an outside corner 20 which is disposed within the recessed center portion 16 are two swing points S1 and S2 which appear in this cross-sectional view of the container as the center points of circles which are hereinafter referred to by their center points. As used herein and in the claims a corner is an "outside corner" if the swing point associated therewith is located exterior of the container and is an "inside corner" if the swing point associated therewith is located exterior of the container. Of course, circles S1 and S2 are actually circular cross sections of toroids (donut shaped structures).

A (not shown in the drawing) is the weighted average of the radii of the two circles S1 and S2, wherein the weighted average of the radii is the quotient of (a) the angular value of an arc of circle S1 which is in contact with the exterior surface of the bottom wall of the container times the radius of circle S1, plus the angular value of an arc of circle S2 which is in contact with the exterior surface of the bottom wall of the container times the radius of circle S2, divided by (b) the sum of the angular values of the two arcs. As will be apparent from the embodiments illustrated in FIGS. 1–7 circles S1 and S2 may or may not have equal radii. As used herein and in the claims the "angular value of an arc" is the value of the included angle having a vertex at the center of a circle and defined by radii of the circle which extend to the end points of the arc. Put another way, in a cross-sectional profile of the exterior surface 13 of the recessed circular center portion 17 of the bottom wall of a container taken in a vertical plane which contains the longitudinal axis 18 of the container, A is the weighted average of the radii of (a) a first circle S1 which is a cross-section of a first toroid which is associated with the curvature of the exterior surface of the bottom of the container at an inside corner 22 which connects the resting surface with the recessed circular center portion and (b) the radius of a second circle S2 which is a cross-section of a second toroid which is associated with the curvature of the exterior surface of an outside corner 20 which is disposed within the recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs.

Figure 5:
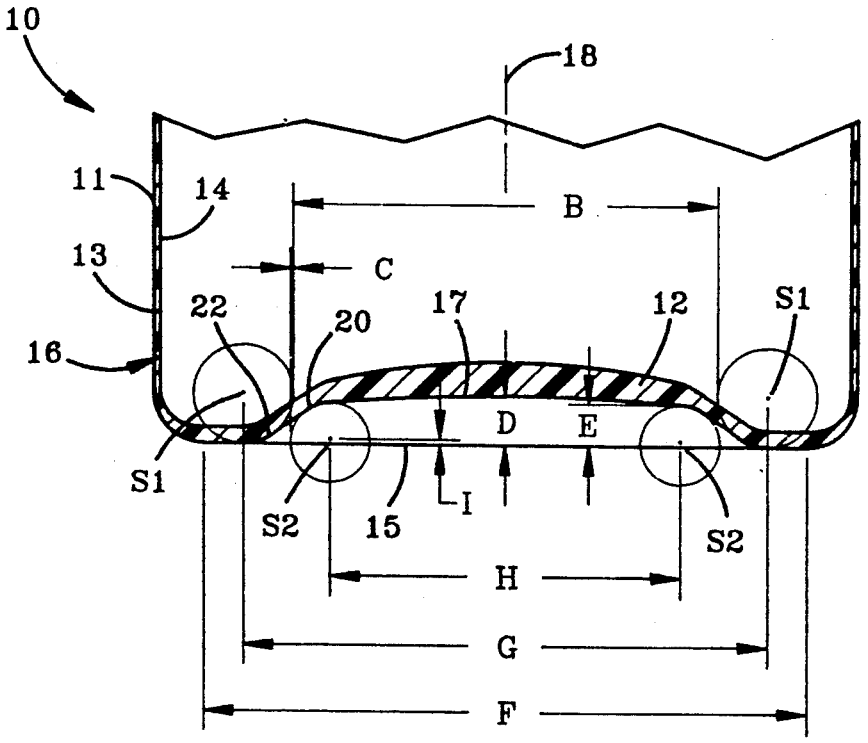

The determination of the value of A may be illustrated by referring to FIG. 5, wherein a preferred container, which will be described below more fully, has a circle S1 with a radius of 0.127 inch and an angular value of the contacting arc being 33°, with the radius of circle S2 being 0.100 inch and an angular value of the contacting arc being 36°.

$$A = \frac{33 * 0.127 + 36 * 0.100}{33 + 36}$$

$$A = 0.113 \text{ inch}$$

B is the minimum horizontal distance measured along a line which intersects the longitudinal axis 18 of the container between a circle S1 on one side of the longitudinal axis and another circle S1 on the other side of the longitudinal axis. Put another way, in a cross-sectional profile of the exterior surface 13 of the recessed circular center portion 17 of the bottom wall of a container taken in a vertical plane which contains the longitudinal axis 18 of the container, B is the minimum horizontal distance between two circles S1, S1 which are disposed on opposite sides of the longitudinal axis 18 of the container with both of these circles being cross-sections of a toroid which is associated with the curvature of the exterior surface of the bottom of the container at an inside corner 22 which connects the resting surface 15 with the recessed circular center portion 17.

C is the horizontal distance measured along a line which intersects the longitudinal axis 18 of the container between a first vertical line which is tangent to a first circle S1 and a second vertical line which is tangent to a second circle S2, both of said vertical lines being located on the same side of the longitudinal axis and both of said vertical lines being interposed between circles S1 and S2. Put another way, in a cross-sectional profile of the exterior surface 13 of the recessed circular center portion 17 of the bottom wall of a container taken in a vertical plane which contains the longitudinal axis 18 of the container, C is the horizontal distance between (a) a first vertical line which is tangent to a first circle S1 which is a cross section of a first toroid which is associated with the curvature of the exterior surface of the bottom of the container at an inside corner 22 which connects the resting surface with the recessed circular center portion and (b) a second vertical line which is tangent to a second circle S2 which is a cross-section of a second toroid which is associated with the curvature of the exterior surface of an outside corner 20 which is disposed within the recessed circular center portion.

D is the vertical distance between (a) a horizontal line which is tangent to the resting surface 15 of the container (b) and the exterior surface 13 of the bottom wall of the container as measured along the longitudinal axis 18 of said container. Put another way, in a cross-sectional profile of the exterior surface 13 of the recessed circular center portion 17 of the bottom wall of a container taken in a vertical plane which contains the longitudinal axis 18 of the container, D is the vertical distance between (a) a horizontal line which is tangent to the resting surface 15 of the container and (b) the exterior 13 surface of the bottom of the container as measured along the longitudinal axis 18 of said container.

E is the vertical distance between (a) the resting surface 15 of the container and (b) a horizontal line which is tangent to the top of a circle S2 associated with the curvature of the exterior surface of the bottom wall of the container at the outside corner 20 which is disposed within the recessed circular center portion. Put another way, in a cross-sectional profile of the exterior surface 13 of the recessed circular center portion 17 of the bottom wall of a container taken in a vertical plane which contains the longitudinal axis 18 of the container, E is the vertical distance between (a) a horizontal line which is tangent to said resting surface and (b) a horizontal line which is tangent to the top of a circle which is a cross-section of a toroid which is associated with the curvature of the exterior surface of an outside corner 20 which is disposed within the recessed circular center portion.

F is the horizontal distance between the radially outer edge of the resting surface 15 on opposite sides of the longitudinal axis 18 of the container as measured on a line which intersects the longitudinal axis. Put another way, in a cross-sectional profile of the exterior surface 13 of the recessed circular center portion 17 of the bottom wall of a container taken in a vertical plane which contains the longitudinal axis 18 of the container, F is the horizontal distance between (a) the radially outer edge of the recessed circular center portion 17 of the bottom wall of the container on one side of the longitudinal axis 18 and (b) the radially outer edge of the recessed circular center portion of the bottom wall of the container on the opposite side of the longitudinal axis.

G is the horizontal distance measured along a line which intersects the longitudinal axis 18 between the centerpoints of circle S1 on one side of the longitudinal axis and circle S1 on the other side of the longitudinal axis. Put another way, in a cross-sectional profile of the exterior surface 13 of the recessed circular center portion of the bottom wall of a container taken in a vertical plane which contains the longitudinal axis 18 of the container, G is the horizontal distance between (a) the center point of a first circle S]on one side of the longitudinal axis and (b) the center point of a second circle S1 on the opposite side of the longitudinal axis, with both of the circles being cross-sections of a toroid which is associated with the curvature of the exterior surface of the bottom of the container at an inside corner 22 which connects the resting surface with the recessed circular center portion.

H is the horizontal distance measured along a line which intersects the longitudinal axis 18 between the centerpoints of a circle S2 on one side of the longitudinal axis and a circle S2 on the other side of the longitudinal axis. Put another way, in a cross-sectional profile of the exterior surface 13 of the recessed circular center portion of the bottom wall of a container taken in a vertical plane which contains the longitudinal axis 18 of the container, H is the horizontal distance between (a) the center point of a first circle S2 on one side of the longitudinal axis and (b) the center point of a second circle S2 on the opposite side of the longitudinal axis, with both of the circles being cross-sections of a toroid which is associated with the curvature of the exterior surface of an outside corner 20 which is disposed within the recessed circular center portion.

I is the vertical distance from the resting surface 15 of the container bottom to the centerpoint of a circle S2 associated with the curvature of the outer surface of the inside corner of the heel. Put another way, in a cross-sectional profile of the recessed circular center portion of the bottom wall of a container taken in a vertical plane which contains the longitudinal axis 18 of the container, I is the vertical distance between (a) a line which is tangent to the resting surface 15 of the container and (b) the center point of a circle S2 which is a cross-section of a toroid which is associated with the curvature of the exterior surface of an outside corner 20 which is disposed within the recessed circular center portion.

Examples of several other base portions for retortable high panel strength plastic containers according to the invention are illustrated in FIGS. 2–7. The reference characters and dimensions of the embodiments illustrated in FIGS. 2–7 correspond with those already described with respect to FIG. 1.

A cross-sectional profile of the exterior surface of the recessed circular center portion of the bottom wall of a plastic container according to the invention taken in a vertical plane which contains the longitudinal axis of the container is described by the following equation:

$$VMAX = CINT + CA*NA + CB*N + CC*NC + CD*ND + CE*NE + CF*N + CAB*NA*NB + CAC*NA*NC + CAF*NA*N + CBC*NB*NC + CBD*NB*ND + CBF*NB*N + CCD*NC*ND + CCF*NC*N + CDE*ND*NE + CDF*ND*N + CEF*NE*N + CA2*NA*NA + CC2*NC*NC + CD2*ND*ND + CF2*N*N$$

where $VMAX \geqq 0.9736 + 0.10795*F - 0.014365*F*F$, with VMAX being the factor by which the volume of the container is increased when the container contains a liquid and is sealed with a closure and is subjected to a predetermined peak sterilization temperature; and $CINT = 0.95141$; $CA = 0.431643$; $CB = 0.0233244$; $CC = 0.444403$; $CD = -0.48394$; $CE = -0.067243$; $CF = 0.162753$; $CAB = -0.17774$; $CAC = -0.88224$; $CAF - 0.031124$; $CBC - 0.24037$; $CBD = 0.246981$; $CBF = 0.0172123$; $CCD = 0.372528$; $CCF = -0.034754$; $CDE = 0.392639$; $CDF = -0.043493$; $CEF = 0.124634$; $CA2 = -0.25598$; $CC2 = -0.39205$; $CD2 = 0.298769$; $CF2 = -0.043109$;

and $N = F / 1.711$; $NA = A/N$; $N8 = B/N$; $NC = C/N$; $ND = D/N$; and $NF = E/N$;

with A, B, C, D, E and F being defined as previously set forth in the description of the embodiment illustrated in FIG. 1 and: A being in the range of 0.044 inch to 2.000 inches; B being in the range of 0.400 inch to 4.000 inches; C being in the range of −1.359 to 0.954; D being in the range of 0.022 inch 1.062 inches; E being in the range of 0.400 inches to 1.001 inches; and, F being in the range of 0.563 inch to 4.000 inches. The ranges for the values of A–F were determined by means of mathematical modeling to determine limits for the variables beyond which the containers are predicted to be subject to catastrophic failure during sterilization.

The significance of the "normalizing factor" N is that 1.711 is the value of the dimension F in the container of the preferred embodiment illustrated in FIGS. 8–11, as can be seen by referring to TABLE I. This base size for a container was successfully developed, and other containers according to the invention are scaled up or down from this base container by normalizing the dimensions. The normalized values for the ranges set forth in the preceding paragraph are as follows: NA is in the range of 0.078 inch to 0.500 inch; NB is in the range of 0.711 inch to 1.546 inches; NC is in the range of −0.340 inch to 0.238 inch; ND is in the range of 0.040 inch to 0.266 inch; NE is in the range of 0.100 inch to 0.250 inch; and N is in the range of 0.329 inch to 2.338 inches.

It is preferred that in a container according to the invention the thickness of the bottom wall, beginning at about the centerline of circle S2, described above, to the radially outer edge of the recessed circular center portion becomes progressively thinner as the radial distance from the longitudinal axis 18 of the container becomes greater.

High panel strength containers according to the present invention may comprise a variety of shapes, a variety of plastics and may be manufactured by a variety of manufacturing methods. Therefor; a bottom profile of the type disclosed herein should be selected by a designer or engineer to be compatible with the plastic(s) and manufacturing method for a particular container in accordance with good engineering practices.

Referring next to FIGS. 8–11 there are shown front, side, top and bottom views, respectfully, of a plastic container according to a preferred embodiment of the present invention. The container 30 has a generally cylindrical main body portion 31. A neck portion 32 having an opening 33 therethrough is disposed at one end of the main body portion, and a base portion 34 is disposed at the other end of the main body portion. A suitable closure (not shown) may be attached to the neck portion by means for attachment such as threads or adhesives or welding after the desired contents are placed in the container. The main body portion has grooves 35 therein which extend circumferentially around the main body portion and function to rigidify the main body portion and increase the panel strength of the container.

Containers having the appearance illustrated in FIGS. 8–11 are disclosed in commonly owned U.S. Design patent applications: Ser. No. 07/826,870 filed on Dec. 13, 1990; and Ser. No. 07/626,873 filed on Dec. 13, 1990; as well as in U.S. Utility patent application Ser. No. 07/627,152 filed on Dec. 13 1990.

Plastic containers according to the invention having the configuration illustrated in FIGS. 8–11 have been manufactured with an overall height 36 of about 3.37 inches, a maximum outside diameter 37 of about 2.05 inches, and are sized to contain about four fluid ounces of a liquid product. It has been determined that a container according to this preferred embodiment with these exemplary dimensions and which is intended to contain a non-oxygen sensitive product such as sterile water may be satisfactorily manufactured entirely of an ethylene-propylene random copolymer (obtainable for example from EXXON as PP-9122) using an injection stretch blow molding method and most preferably having the bottom profile illustrated in FIG. 6. The predetermined peak sterilization temperature for these containers is in the range of 250° F. to 266° F., with a target for sterilizer pressure in the range of saturated steam pressure to saturated steam +12 p.s.i. air pressure. In the preferred embodiment the side wall of the container has a thickness in the range of about 0.02 inch to 0.05 inch and the bottom wall has a thickness in the range of about 0.04 inch to 0.12 inch. It has also been determined that satisfactory containers according to this preferred embodiment may be manufactured using any of the bottom profiles illustrated in FIGS. 1–4. In each of these embodiments the radii of circles S1 and S2 are equal. The dimensions for the bottom profiles which are satisfactory and preferred for this preferred embodiment are set forth in TABLE I, with all of the dimensions being in inches. A container in accordance with any of the embodiments set forth in TABLE I, has VMAX=1.116.

TABLE I

| FIG. | DIMENSIONS IN INCHES | | | | | | | | |
|---|---|---|---|---|---|---|---|---|---|
| No | A | B | C | D | E | F | G | H | I |
| 1 | 0.103 | 1.480 | 0.238 | 0.040 | 0.100 | 1.711 | 1.686 | 0.797 | −0.003 |
| 2 | 0.144 | 1.424 | −0.004 | 0.261 | 0.240 | 1.711 | 1.711 | 1.145 | 0.096 |
| 3 | 0.078 | 1.546 | 0.002 | 0.188 | 0.185 | 1.711 | 1.701 | 1.387 | 0.109 |
| 4 | 0.083 | 1.546 | 0.002 | 0.188 | 0.218 | 1.711 | 1.711 | 1.377 | 0.136 |
| 6 | 0.078 | 1.546 | 0.002 | 0.138 | 0.147 | 1.711 | 1.711 | 1.230 | 0.010 |

It has been determined that a container according to the embodiment illustrated in FIGS. 8–11 intended to contain an oxygen sensitive product such as a milk-based nutritional product for human infants is preferably manufactured with plurality of layers of plastics. The plastic which forms the interior surface of the container should be a material which is chemically inert with respect to the contents of the container, and one of the layers of plastic should be a material that is substantially impermeable to air. A satisfactory multilayer container according to FIGS. 8–11 has been manufactured having the structure set forth in TABLE II, with layer 1 being the layer which forms the interior surface of the container and each successively numbered layer progressing towards the exterior of the container. An interesting feature of this multilayer structure is the composition of layer 2 from a mixture of virgin materials plus recycled materials which were flashing or unsatisfactory containers, with the recycling being done regularly as part of the container manufacturing process. Layer 4 is the gas barrier layer and layers 3 and 5 are adhesive layers.

TABLE II

| LAYER | MATERIAL | PERCENT OF WALL THICKNESS | SUPPLIER |
|---|---|---|---|
| 1 | ethylene-propylene random copolymer | 14 | EXXON, PP-9122 |
| 2 | mixture of all components of the multilayer wall | 65 | CONTAINER MANUFACTURER |
| 3 | maleic anhydride-polypropylene graft copolymer | 1.5 | MITSUI, Admer QF-500 |
| 4 | ethylene vinyl alcohol copolymer | 4 | EVALCA, either EVAL SC F-101A or EVAL LC F-101A |
| 5 | maleic anhydride-propylene graft copolymer | 1.5 | MITSUI, Admer QF-500 |
| 6 | ethylene-propylene random copolymer | 14 | EXXON, PP-9122 |

Figure 6:
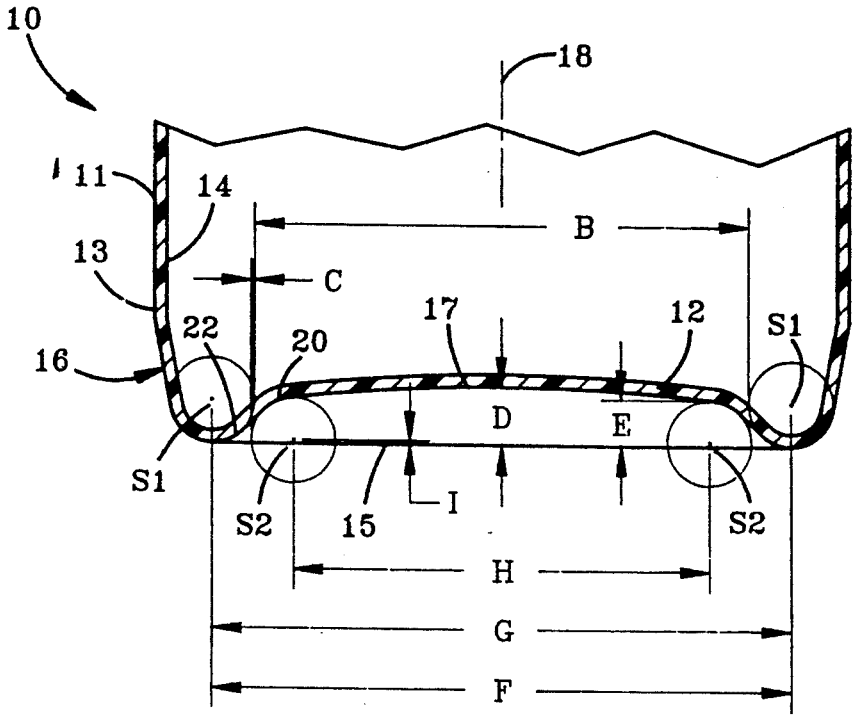

This container was manufactured by a co-extrusion blow molding process with the bottom profile illustrated in FIG. 6 and the dimensions set forth in TABLE I. The predetermined peak sterilization temperature for these containers is in the range of 250° F. to 266° F., with a target for sterilization pressure in the range of saturated steam pressure to saturated steam +5 p.s.i. air pressure. In this preferred embodiment the side wall of the container has a thickness in the range of about 0.02 inch to 0.05 inch and the bottom wall has a thickness in the range of about 0.04 inch to 0.08 inch.

Referring next to FIGS. 12–15 there are shown front, side, top and bottom views, respectfully, of a plastic container according to a second aspect of the invention. The container 40 has a generally cylindrical main body portion 41. A neck portion 42 having an opening 43 therethrough is disposed at one end of the main body portion with a flange 44 interposed between the neck portion and the main body portion. A suitable closure (not shown) may be threadably attached to the neck portion after the desired contents are placed in the container. A base portion 45 is disposed at an opposite end of the main body portion from the neck portion.

Containers having the appearance illustrated in FIGS. 12–15 are disclosed in commonly owned U.S. Design patent applications: Ser. No. 07/626,869 filed on Dec. 13, 1990; Ser. No. 07/626,874 filed on Dec. 13, 1990; and Ser. No. 07/626,875 filed on Dec. 13, 1990; as well as in U.S. Utility patent application Ser. No. 07/627,152 filed on Dec. 13, 1990.

A preferred embodiment of a plastic container having the configuration shown in FIGS. 12–15 has an overall height 45 of about 4.2 inches, a maximum outside diameter 47 of about 1.76 inches in the base portion 45, an outside diameter of about 1.32 inches in the main body portion 41, and is intended to contain about two fluid ounces of a liquid nutritional product. It has been determined that a container according to this preferred embodiment and which is intended to contain a non-oxygen sensitive liquid product such as sterile water may be satisfactorily manufactured entirely of an ethylene-propylene random copolymer (available from EXXON as PP-9122) using an injection stretch blow molding method and most preferably the bottom profile illustrated in FIG. 5, wherein the radius of circle S1 is 0.125 inch, the radius of circle S2 is 0.100 inch; A=0.113 inch; B=1.062 inch; C=0.007 inch; D=0.124 inch; E=0.104 inch; F=1.510 inch; G=1.312 inch; H=0.876 inch; and I=0.040 inch, and has a VMAX of 1.113. The predetermined peak sterilization temperature for these containers is in the range of 250° F. to 266° F., with a target for sterilization pressure in the range of saturated steam pressure to saturated steam +12 p.s.i. air pressure. in the preferred embodiment the side wall of the container has a thickness in the range of about 0.02 inch to 0.05 inch and the bottom wall has a thickness in the range of about 0.04 inch to 0.10 inch.

It has been determined that a container according to the embodiment illustrated in FIGS. 12–15 intended to contain an oxygen-sensitive liquid product such as milk-based nutritional product for human infants is preferably manufactured with a plurality of layers of plastics. The plastic which forms the interior surface of the container should be a material which is chemically inert with respect to the contents of the container, and one of the layers of plastic should be a material that is substantially impermeable to air. A container according to FIGS. 12–15 having the structure set forth above in TABLE II, with layer 1 being the layer which forms the interior surface of the container and each successively numbered layer progressing towards the exterior of the container has been manufactured by a co-extrusion blow molding process with the bottom profile illustrated in FIG. 5 and the same dimensions set forth in the immediately preceding paragraph for a monolayer container. However; the predetermined peak sterilization temperature for this multilayer container is in the range of 250° F. to 266° F. with a target sterilization pressure in the range of saturated steam pressure to saturated steam +5 p.s.i. air pressure. In this preferred multilayer embodiment the side wall of the container has a thickness in the range of about 0.02 inch to 0.05 inch and the bottom wall has a thickness in the range of about 0.06 inch to 0.11 inch.

Referring next to FIGS. 16–19 there are shown front, side, top and bottom views, respectfully, of a plastic container according to a third embodiment of the invention. The container 50 of this embodiment has a main body portion 51 having a substantially rectangular cross-sectional profile as opposed to the circular cross-sectional profiles of the first two embodiment which have already been described. A neck portion 52 having an opening 53 therethrough is disposed at one end of the main body portion, and a base portion 54 is disposed at the other end of the main body portion. A suitable closure (not shown) may be threadably attached to the neck portion after the desired contents are placed in the container. The main body portion 51 has grooves 55 therein which extend completely thereabout and function to rigidify the main body portion and increase the panel strength of the container.

In an exemplary embodiment a plastic container having the configuration illustrated in FIGS. 16–19 has an overall height 56 of about 8.0 inches, a maximum width 57 and depth 58 which are both about 3.44 inches, and the recessed circular center portion in the bottom of the base portion has an outside diameter 59 of about 2.75 inches and is intended to contain about one liter of a liquid product. A plastic container according to this embodiment illustrates the use of the circular bottom profiles disclosed herein in conjunction with a container having a substantially rectangular cross-section.

Figure 7:
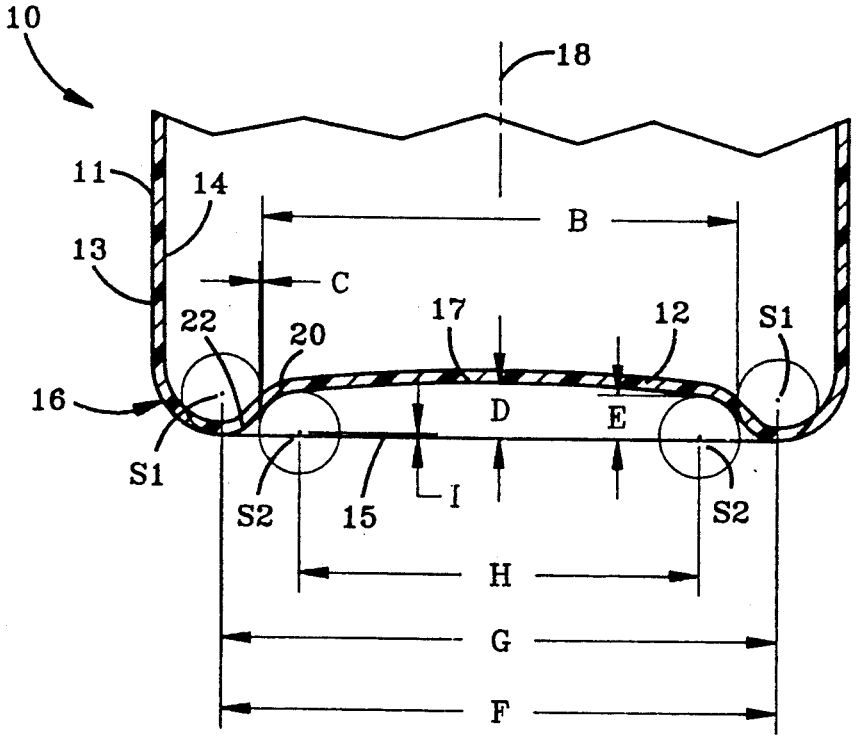
Figure 10:
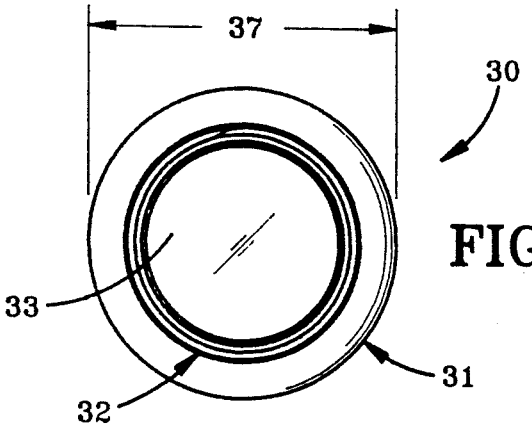
FIGS. 8–11 are front, side, top and bottom views, respectively, of a plastic container according to one embodiment of the invention.
Figure 8:
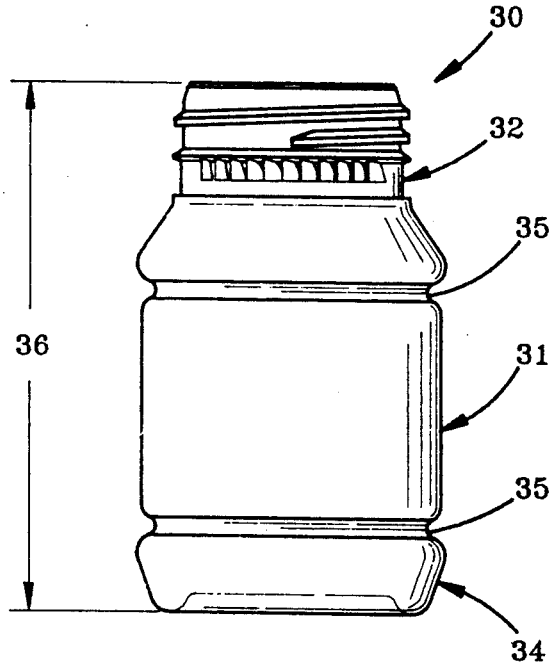
Figure 9:
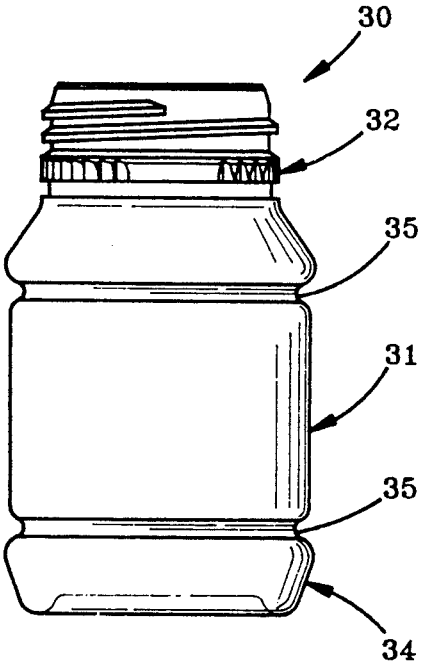
Figure 11:
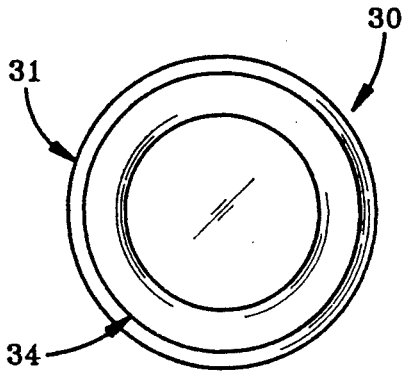
Figure 14:
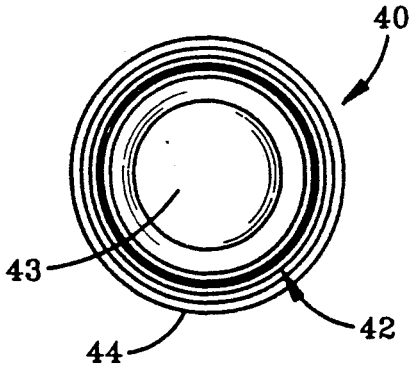
FIGS. 12–15 are front, side, top and bottom views, respectively, of a plastic container according to another embodiment of the invention; and, FIGS. 16–19 are front, side, top and bottom views, respectively, of a plastic container according to yet another embodiment of the invention.
Figure 12:
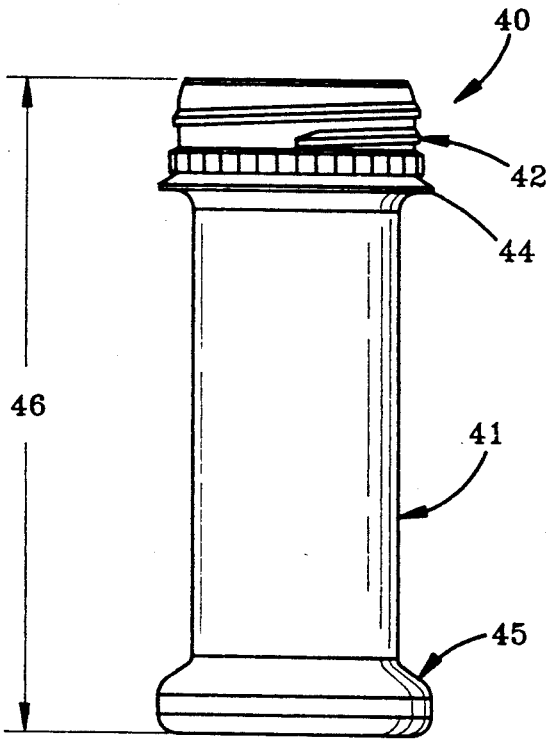
Figure 13:
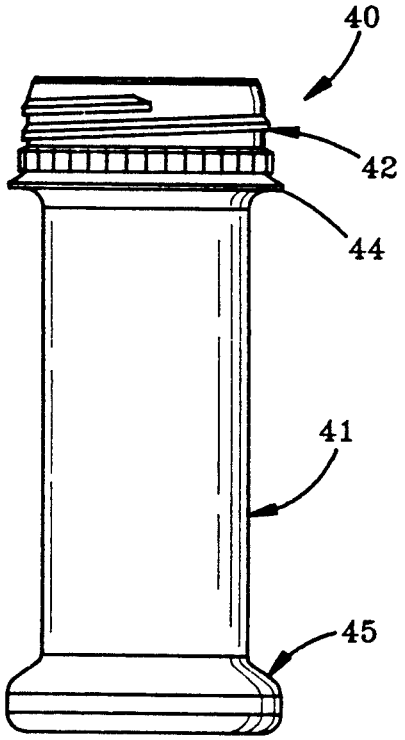
Figure 15:
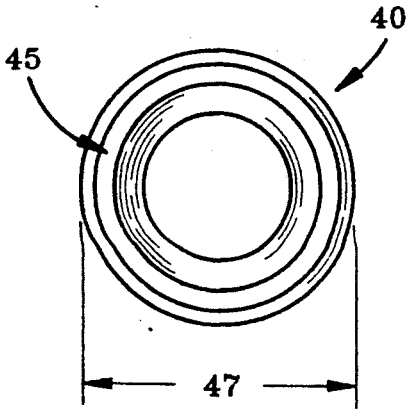
Figure 18:
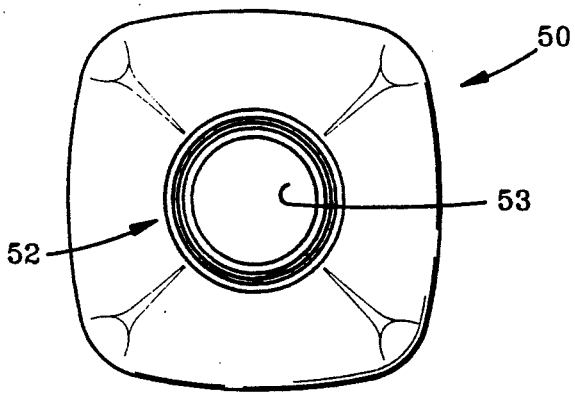
Figure 17:
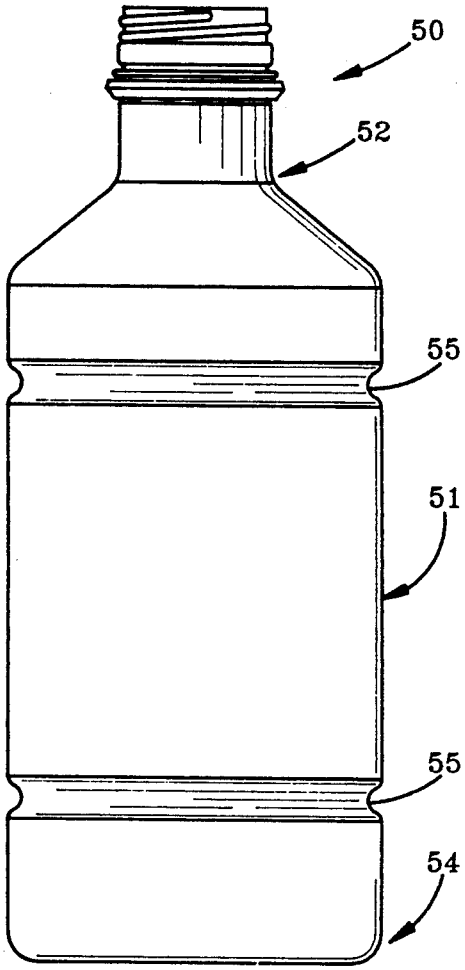
Figure 16:
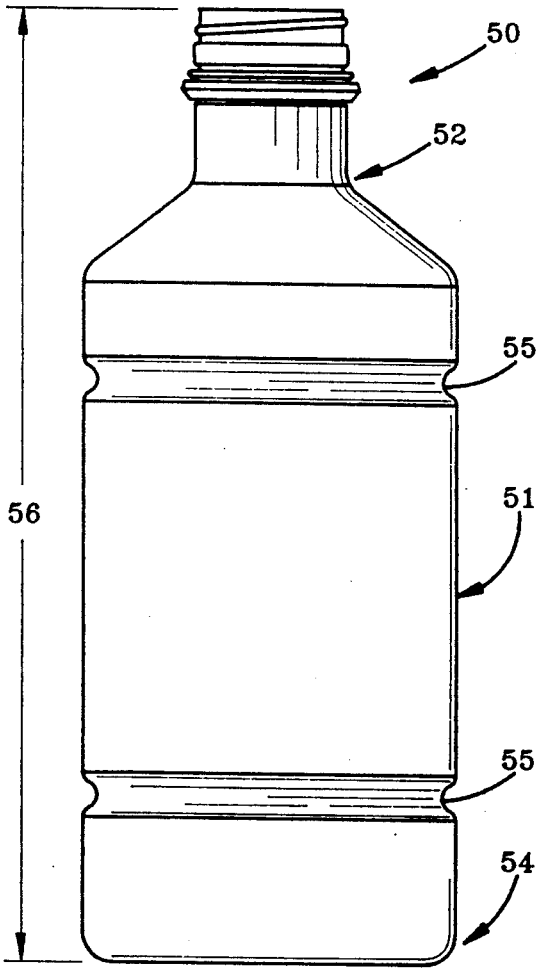
Figure 19:
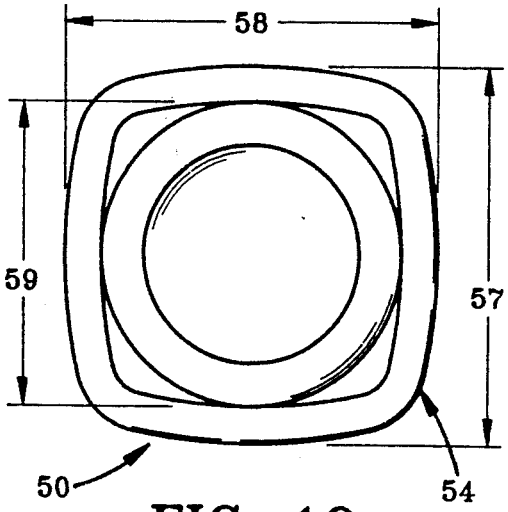

It has been determined that a container according to the embodiment illustrated in FIGS. 16–19 intended to contain a non-oxygen sensitive product such as sterile water may be satisfactorily manufactured entirely of an ethylene-propylene random copolymer (obtainable from EXXON as PP-9122) using an injection stretch blow molding method, and the bottom profile illustrated in FIG. 7, wherein the radii of circles S1 and S1 are equal and A=0.201 inch; B=2.347 inch; C=0.015 inch; D=0.273 inch; E=0.204 inch; F=2.750 inch; G=2.748 inch; H=1.976 inch; and I=0.003 inch, and a VMAX of 1.171. The predetermined peak sterilization temperature for a container according to this embodiment is in the range of 244° F. to 266° F., with a target for sterilization pressure in the range of saturated steam pressure to saturated steam +18 p.s.i. air pressure. In this preferred embodiment the side wall of the container has a thickness in the range of about 0.02 inch to 0.05 inch and the bottom wall has a thickness in the range of about 0.06 inch to 0.16 inch.

While certain representative embodiments and details have been described for the purpose of illustrating the invention, it will be apparent to those skilled in the art that various changes and modifications may be made therein without departing from the spirit or scope of the invention.

We claim:

1. A retortable plastic container capable of being subjected to a peak sterilization temperature in the range of 250° F. to 266° F. without catastrophic failure, said container comprising a sidewall and a bottom wall formed as a single piece, said container having a panel strength of greater than 2.54 p.s.i., said bottom wall having an exterior surface with the lowermost portion thereof being a resting surface which extends circumferentially about a recessed circular center portion of the bottom wall of the container, said recessed circular center portion having a longitudinal axis of the container for a center thereof, a cross-sectional profile of the exterior surface of the recessed circular center portion of the bottom wall of the container taken in a vertical plane which contains the longitudinal axis of the container being described by the following equation:

$$VMAX=CINT+CA*NA+CB*N+CC*NC+CD*ND+CE*NE+CF*N+CAB*NA*NB+CAC*NA*NC+CAF*NA*N+CBC*NB*NC+CBD*NB*ND+CBF*NB*N+CCD*NC*ND+CCF*NC*N+CDE*ND*NE+CDF*ND*N+CEF*NE*N+CA2*NA*NA+CC2*NC*NC+CD2*ND*ND+CF2*N*N$$

where $VMAX \geqq 0.9736+0.10795*F-0.014365*F*F$, with VMAX being the factor by which the volume of the container is increased when the container contains a liquid and is sealed with a closure and is subjected to a peak sterilization temperature in the range of 250° F. to 266° F; and $CINT=0.95141$; $CA=0.431643$; $CB=0.0233244$; $CC=0.444403$; $CD=-0.48394$; $CE=-0.067243$; $CF=0.162753$; $CAB=-0.17774$; $CAC=-0.88224$; $CAF-0.031124$; $CBC-0.24037$; $CBD=0.246981$; $CBF=0.0172123$; $CCD=0.372528$; $CCF=-0.034754$; $CDE=0.392639$; $CDF=-0.043493$; $CEF=0.124634$; $CA2=-0.25598$; $CC2=-0.39205$; $CD2=0.298769$; $CF2=-0.043109$;

and

N=F /1.711; NA=A/N; N8=B/N; NC=C/N; ND=D/N; and NF=E/N;

A being in the range of 0.044 inch to 2.000 inches and being the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B being in the range of 0.400 inch to 4.000 inches and being the minimum horizontal distance between two circles which are disposed on opposite sides of the longitudinal axis of the container and are both cross sections of said first toroid;

C being in the range of −1.359 to 0.954 inch and being the horizontal distance between (a) a first vertical line which is tangent to a firs circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D being in the range of 0.022 inch to 1.062 and being the vertical distance between (a) a horizontal line which is tangent to said resting surface and (b) the exterior surface of the bottom of said container at the longitudinal axis of said container;

E being in the range of 0.400 inch to 1.001 inches and being the vertical distance between (a) a horizontal line which is tangent to said resting surface and (b) a horizontal line which is tangent to the top of a circle which is a cross-section of said second toroid; and, F being in the range of 0.563 inch to 4.000 inches and being the horizontal distance between (a) the radially outer edge of the recessed circular center portion on one side of the longitudinal axis and (b) the radially outer edge of the recessed circular portion on the opposite side of the longitudinal axis.

2. A retortable plastic container according to claim 1 wherein the container consists of only a single material.

3. A retortable plastic container according to claim 1 wherein the container comprises a plurality of layers of different materials.

4. A retortable plastic container according to claim 1 wherein the container consists of only a single material and a main body portion of the container has a cross-sectional shape, taken perpendicular to the longitudinal axis of the container, which is substantially circular.

5. A retortable plastic container according to claim 1 wherein the container consists of only a single material and a main body portion of the container has a cross-sectional shape, taken perpendicular to the longitudinal axis of the container, which is substantially rectangular.

6. A retortable plastic container according to claim 1 wherein the container comprises a plurality of layers of different materials and a main body portion of the container has a cross-sectional shape, taken perpendicular to the longitudinal axis of the container, which is substantially circular.

7. An assembly comprising: (a) a retortable plastic container capable of being subjected to a peak sterilization temperature in the range of 250° F. to 266° F. without catastrophic failure, (b) a liquid contained in the container, and (c) a closure attached to the container by means for attachment, said retortable plastic container comprising: a sidewall and a bottom wall formed as a single piece, said container having a panel strength of greater than 2.54 p.s.i., said bottom wall having an exterior surface with the lowermost portion thereof being a resting surface which extends circumferentially about a recessed circular center portion of the bottom wall of the container, said recessed circular center portion having a longitudinal axis of the container for a center thereof, a cross-sectional profile of the exterior surface of the recessed circular center portion of the bottom wall of the container taken in a vertical plane which contains the longitudinal axis of the container being described by the following equation:

$$VMAX=CINT+CA*NA+CM*N+CC*NC+CD*ND+CD*NE+CF*N+CAB*NA*NB+CAC*NA*NC+CAF*NA*N+CBC*NB*NC+CBD*NB*ND+CBF*NB*N+CCD*NC*ND+CCF*NC*N+CDE*ND*NE+CDF*ND*N+CEF*N3*N+CA2*NA*NA+CC2NC*NC+CD2*ND*ND+CF2*N*N$$

where $VMAX \geqq 0.9736+0.10795*F-0.014365*F*F$, with VMAX being the factor by which the volume of the container is increased when the container contains a liquid and is sealed with a closure and is subjected to a peak sterilization temperature in the range of 250° to 266° F.; and $CINT=0.95141$; $CA=0.431643$; $CB=0{,}0233244$; $CC=0.444403$; $CD=-0.48394$; $CE=-0.067243$; $CF=0.162753$; $CAB=-0.17774$; $CAC=-0.88224$; $CAF=-0.031124$; $CBC=-0.24037$; $CBD=0.246981$; $CBF=0.0172123$; $CCD=0.372528$; $CCF=-0.034754$; $CDE=0.392639$; $CDF=-0.043493$; $CEF=0.124634$; $CA2=-0.25598$; $CC2=-0.39205$; $CD2=0.298769$; $CF2=-0.043109$;

and

N=F /1.711; NA=A/N; N8=B/N; NC=C/N; ND=D/N; and NF=E/N; with

A being in the range of 0.044 inch to 2.000 inches and being the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B being in the range of 0.400 inch to 4.000 inches and being the minimum horizontal distance between two circles which are disposed on opposite sides of the longitudinal axis of the container and are both cross sections of said first toroid;

C being in the range of −1.359 to 0.954 inch and being the horizontal distance between (a) a first vertical line which is tangent to a firs circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D being in the range of 0.022 inch to 1.062 and being the vertical distance between (a) a horizontal line which is tangent to said resting surface and (b) the exterior surface of the bottom of said container at the longitudinal axis of said container;

E being in the range of 0.400 inch to 1.001 inches and being the vertical distance between (a) a horizontal line which is tangent to said resting surface and (b) a horizontal line which is tangent to the top of a circle which is a cross-section of said second toroid; and, F being in the range of 0.563 inch to 4.000 inches and being the horizontal distance between (a) the radially outer edge of the recessed circular center portion on one side of the longitudinal axis and (b) the radially outer edge of the recessed circular portion on the opposite side of the longitudinal axis.

8. An assembly according to claim 7 wherein the container consists of only a single material.

9. An assembly according to claim 7 wherein the container comprises a plurality of layers of different materials.

10. An assembly according to claim 7 wherein the container consists of only a single material and a main body portion of the container has a cross-sectional shape, taken perpendicular to the longitudinal axis of the container, which is substantially circular.

11. An assembly according to claim 7 wherein the container consists of only a single material and a main body portion of the container has a cross-sectional shape, taken perpendicular to the longitudinal axis of the container, which is substantially rectangular.

12. An assembly according to claim 7 wherein the container comprises a plurality of layers of different materials and a main body portion of the container has a cross-sectional shape, taken perpendicular to the longitudinal axis of the container, which is substantially circular.

13. A retortable plastic container capable of being subjected to a peak sterilization temperature in the range of 250° F. to 266° F. without catastrophic failure, said container comprising a generally cylindrical main body portion, a neck portion having an opening therethrough being disposed at one end of the main body portion, and a base portion being disposed at the other end of the main body portion, the container being formed as a single piece and having a panel strength of greater than 2.54 p.s.i., the container having an overall height of about 3.4 inches, a maximum outside diameter of about 2 inches and a capacity of about four fluid ounces, a bottom wall of the container having an exterior surface with the lowermost portion thereof being a resting surface which extends circumferentially about a recessed circular center portion of the bottom wall of the container, the recessed circular center portion having a longitudinal axis of the container for a center thereof, a cross-sectional profile of the exterior surface of the recessed circular center portion of the bottom wall of the container taken in a vertical plane which contains the longitudinal axis of the container being selected from the group consisting of profiles 1 through 5 set forth in the following table:

| PROFILE | [DIMENSION] DIMENSIONS IN INCHES | | | | | | | | |
|---|---|---|---|---|---|---|---|---|---|
| NO. | A | B | C | D | E | F | G | H | I |
| 1 | 0.103 | 1.480 | 0.238 | 0.040 | 0.100 | 1.711 | 1.686 | 0.797 | −0.003 |
| 2 | 0.144 | 1.424 | −0.004 | 0.261 | 0.240 | 1.711 | 1.711 | 1.145 | 0.096 |
| 3 | 0.078 | 1.546 | 0.002 | 0.188 | 0.185 | 1.711 | 1.701 | 1.387 | 0.109 |
| 4 | 0.083 | 1.546 | 0.002 | 0.188 | 0.218 | 1.711 | 1.711 | 1.377 | 0.136 |
| 5 | 0.078 | 1.546 | 0.002 | 0.138 | 0.147 | 1.711 | 1.711 | 1.230 | 0.010 |

and wherein:

A is the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B is the minimum horizontal distance between two circles which are disposed on opposite sides of the longitudinal axis of the container and are both cross sections of said first toroid;

C is the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D is the vertical distance between (a) a horizontal line which is tangent to said resting surface and (b) the exterior surface of the bottom of said container at the longitudinal axis of said container;

E is the vertical distance between (a) a horizontal line which is tangent to said resting surface and (b) a horizontal line which is tangent to the top of a circle which is a cross-section of said second toroid;

F is the horizontal distance between (a) the radially outer edge of the recessed circular center portion on one side of the longitudinal axis and (b) the radially outer edge of the recessed circular portion on the opposite side of the longitudinal axis;

G is the horizontal distance between (a) the center point of a first circle on one side of the longitudinal axis and (b) the center point of a second circle on the opposite side of the longitudinal axis with both of the circles being cross-sections of said first toroid;

H is the horizontal distance between (a) the center point of a first circle on one side of the longitudinal axis and (b) the center point of a second circle on the opposite side of the longitudinal axis with both of the circles being cross-sections of said second toroid; and I is the vertical distance between (a) a line which is tangent to said resting surface and (b) the center point of a circle which is a cross-section of said second toroid.

14. A retortable plastic container according to claim 13 wherein the container consists of only a single material.

15. A retortable plastic container according to claim 13 wherein the container comprises a plurality of layers of different materials.

16. A retortable plastic container capable of being subjected to a peak sterilization temperature in the range of 250° F. to 266° F. without catastrophic failure, said container comprising a generally cylindrical main body portion which has an outside diameter of about 1.3 inches, a neck portion having an opening therethrough is disposed at one end of the main body portion with a flange interposed between the neck portion and the main body portion, a base portion having an outside diameter of about 1.8 inches is disposed at the other end of the main body portion, the container having a capacity of about two fluid ounces, the container being formed as a single piece and having a panel strength of greater than 2.54 p.s.i., a bottom wall of the container having an exterior surface with the lowermost portion thereof being a resting surface which extends circumferentially about a recessed circular center portion of the bottom wall of the container, the recessed circular center portion having a longitudinal axis of the container for a center thereof, a cross-sectional profile of the exterior surface of the recessed circular center portion of the bottom wall of the container taken in a vertical plane which contains the longitudinal axis of the container being described as follows:

A is about 0.113 inches and is the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B is about 1.062 inches and is the minimum horizontal distance between two circles which are disposed on opposite sides of the longitudinal axis of the container and are both cross sections of said first toroid;

C is about 0.007 inches and is the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines begin interposed between said circles;

D is about 0.124 inch and is the vertical distance between (a) a horizontal line which is tangent to said resting surface and (b) the exterior surface of the bottom of said container at the longitudinal axis of said container;

E is about 0.104 inch and is the vertical distance between (a) a horizontal line which is tangent to said resting surface and (b) a horizontal line which is tangent to the top of a circle which is a cross-section of said second toroid;

F is about 1.510 inches and is the horizontal distance between (a) the radially outer edge of the recessed circular center portion on one side of the longitudinal axis and (b) the radially outer edge of the recessed circular portion on the opposite side of the longitudinal axis;

G is about 1.312 inches and is the horizontal distance between (a) the center point of a first circle on one side of the longitudinal axis and (b) the center point of a second circle on the opposite side of the longitudinal axis with both of the circles being cross-sections of said first toroid;

H is about 0.867 inch and is the horizontal distance between (a) the center point of a first circle on one side of the longitudinal axis and (b) the center point of a second circle on the opposite side of the longitudinal axis with both of the circles being cross-sections of said second toroid; and I is about 0.040 inch and is the vertical distance between (a) a line which is tangent to said resting surface and (b) the center point of a circle which is a cross-section of said second toroid.

17. A retortable plastic container according to claim 16 wherein the container consists of only a single material.

18. A retortable plastic container according to claim 16 wherein the container comprises a plurality of layers of different materials.

19. An assembly comprising: (a) a retortable plastic container capable of being subjected to a peak sterilization temperature in the range of 250° F. to 266° F. without catastrophic failure, (b) about four ounces of liquid contained in the container, and (c) a closure attached to the container by means for attachment, said retortable plastic container comprising:

a generally cylindrical main body portion, a neck portion having an opening therethrough being disposed at one end of the main body portion, and a base portion being disposed at the other end of the main body portion, the container being formed as a single piece and having a panel strength of greater than 2.54 p.s.i., the container having an overall height of about 3.4 inches, a maximum outside diameter of about 2 inches and a capacity of about four fluid ounces, a bottom wall of the container having an exterior surface with the lowermost portion thereof being a resting surface which extends circumferentially about a recessed circular center portion of the bottom wall of the container, the recessed circular center portion having a longitudinal axis of the container for a center thereof, a cross-sectional profile of the exterior surface of the recessed circular center portion of the bottom wall of the container taken in a vertical plane which contains the longitudinal axis of the container being selected from the group consisting of profiles 1 through 5 set forth in the following table:

| PROFILE | [DIMENSION] DIMENSIONS IN INCHES | | | | | | | | |
|---|---|---|---|---|---|---|---|---|---|
| No | A | B | C | D | E | F | G | H | I |
| 1 | 0.103 | 1.480 | 0.238 | 0.040 | 0.100 | 1.711 | 1.686 | 0.797 | −0.003 |
| 2 | 0.144 | 1.424 | −0.004 | 0.261 | 0.240 | 1.711 | 1.711 | 1.145 | 0.096 |
| 3 | 0.078 | 1.546 | 0.002 | 0.188 | 0.185 | 1.711 | 1.701 | 1.387 | 0.109 |
| 4 | 0.083 | 1.546 | 0.002 | 0.188 | 0.218 | 1.711 | 1.711 | 1.377 | 0.136 |
| 5 | 0.078 | 1.546 | 0.002 | 0.138 | 0.147 | 1.711 | 1.711 | 1.230 | 0.010 |

and wherein:

A is the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B is the minimum horizontal distance between two circles which are disposed on opposite sides of the longitudinal axis of the container and are both cross sections of said first toroid;

C is the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D is the vertical distance between (a) a horizontal line which is tangent to said resting surface and (b) the exterior surface of the bottom of said container at the longitudinal axis of said container;

E is the vertical distance between (a) a horizontal line which is tangent to said resting surface and (b) a horizontal line which is tangent to the top of a circle which is a cross-section of said second toroid;

F is the horizontal distance between (a) the radially outer edge of the recessed circular center portion on one side of the longitudinal axis and (b) the radially outer edge of the recessed circular portion on the opposite side of the longitudinal axis;

G is the horizontal distance between (a) the center point of a first circle on one side of the longitudinal axis and (b) the center point of a second circle on the opposite side of the longitudinal axis with both of the circles being cross-sections of said first toroid;

H is the horizontal distance between (a) the center point of a first circle on one side of the longitudinal axis and (b) the center point of a second circle on the opposite side of the longitudinal axis with both of the circles being cross-sections of said second toroid; and I is the vertical distance between (a) a line which is tangent to said resting surface and (b) the center point of a circle which is a cross-section of said second toroid.

20. An assembly comprising: (a) a retortable plastic container capable of being subjected to a peak sterilization temperature in the range of 200° F. to 266° F. without catastrophic failure, (b) about two ounces of a liquid contained in the container; and (c) a closure attached to the container by means for attachment, said retortable plastic container comprising: a generally cylindrical main body portion which has an outside diameter of about 1.3 inches, a neck portion having an opening therethrough is disposed at one end of the main body portion with a flange interposed between the neck portion and the main body portion, a base portion having an outside diameter of about 1.8 inches is disposed at the other end of the main body portion, the container having a capacity of about tow fluid ounces, the container being formed as a single piece and having a panel strength of greater then 2.54 p.s.i., a bottom wall of the container having an exterior surface with the lowermost portion thereof being a resting surface which extends circumferentially about a recessed circular center portion of the bottom wall of the container, the recessed circular center portion having a longitudinal axis of the container for a center thereof, a cross-sectional profile of the exterior surface of the recessed circular center portion of the bottom wall of the container taken in a vertical plane which contains the longitudinal axis of the container being described as follows:

A is about 0.113 inch and is the weighted average of the radii of (a) a first circle which is a cross-section of a first toroid which is associated with the curvature of the exterior surface of the bottom of the container at an inside corner which connects the resting surface with said recessed circular center portion and (b) the radius of a second circle which is a cross-section of a second toroid which is associated with the curvature of the exterior surface of an outside corner which is disposed within said recessed circular center portion; wherein the weighted average of the radii is the quotient of (a) the angular value of an arc of the first circle which is in contact with the exterior surface of the bottom wall of the container times the radius of the first circle, plus the angular value of an arc of the second circle which is in contact with the exterior surface of the bottom wall of the container times the radius of the second circle, divided by (b) the sum of the angular values of the two arcs; the thickness of the bottom wall of the container beginning at about the center of said second circle to the radially outer edge of the recessed circular portion becomes progressively thinner as the radial distance from the longitudinal axis of the container becomes greater;

B is about 1.062 inches and is the minimum horizontal distance between two circles which are disposed on opposite sides of the longitudinal axis of the container and are both cross sections of said first toroid;

C is about 0.007 inch and is the horizontal distance between (a) a first vertical line which is tangent to a first circle which is a cross-section of said first toroid and (b) a second vertical line which is tangent to a second circle which is a cross-section of said second toroid with both of said circles being located on the same side of the longitudinal axis of the container and both of said vertical lines being interposed between said circles;

D is about 0.124 inch and is the vertical distance between (a) a horizontal line which is tangent to said resting surface and (b) the exterior surface of the bottom of said container at the longitudinal axis of said container;

E is about 0.104 inch and is the vertical distance between (a) a horizontal line which is tangent to said resting surface and (b) a horizontal line which is tangent to the top of a circle which is a cross-section of said second toroid;

F is about 1.510 inches and is the horizontal distance between (a) the radially outer edge of the recessed circular center portion on one side of the longitudinal axis and (b) the radially outer edge of the recessed circular portion on the opposite side of the longitudinal axis;

G is about 1.312 inch and is the horizontal distance between (a) the center point of a first circle on one side of the longitudinal axis and (b) the center point of a second circle on the opposite side of the longitudinal axis with both of the circles being cross-sections of said first toroid;

H is about 0.867 inch and is the horizontal distance between (a) the center point of a first circle on one side of the longitudinal axis and (b) the center point of a second circle on the opposite side of the longitudinal axis with both of the circles being cross-sections of said second toroid; and I is about 0.040 inch and is the vertical distance between (a) a line which is tangent to said resting surface and (b) the center point of a circle which is a cross-section of said second toroid.

* * * * *

UNITED STATES PATENT AND TRADEMARK OFFICE

CERTIFICATE OF CORRECTION

PATENT NO. : 5,217,737

DATED : June 8, 1993

INVENTOR(S) : Ralph A. Gygax, Joseph M. Lippian, Thomas D. Loughrin, William T. Malone, Thomas W. Osip, Paul A. Pezzoli It is certified that error appears in the above-indentified patent and that said Letters Patent is hereby corrected as shown below:

Column 6, line 51, "S]on" should be --S1 on--
Column 8, line 57, "N8 = B/N" should be --NB=B/N--
Column 13, line 2, "N8=B/N" should be --NB=B/N--
Column 13, line 33, "firs" should be --first--
Column 14, line 36, "CM*N" should be --CB*N--
Column 14, line 37, "CD*NE" should be --CE*NE--
Column 14, line 41, "CEF*N3*N" should be --CEF*NE*N--
Column 14, line 42, "CC2NC*NC" should be --CC2*NC*NC--
Column 14, line 61, "N8=B/N" should be --NB=B/N
Column 14, line 62, "NF=E/N should be --NE=E/N--
Column 15, line 28, "firs" should be --first--
Column 15, line 39, "[DIMENSION]" should be deleted
Column 19, line 52, "[DIMENSION]" should be deleted Column 21, line 19, "tow" should be --two--

Signed and Sealed this

Thirty-first Day of May, 1994

Bruce Lehman

*Attest:*

BRUCE LEHMAN

*Attesting Officer*

*Commissioner of Patents and Trademarks*